US008393193B2

(12) United States Patent
Sperrer

(10) Patent No.: US 8,393,193 B2
(45) Date of Patent: Mar. 12, 2013

(54) BENDING MACHINE

(75) Inventor: Gerhard Sperrer, Schlierbach (AT)

(73) Assignee: Trumpf Maschinen Austria GmbH & Co. KG. (AT)

( * ) Notice: Subject to any disclaimer, the term of this patent is extended or adjusted under 35 U.S.C. 154(b) by 341 days.

(21) Appl. No.: 12/664,978

(22) PCT Filed: May 7, 2008

(86) PCT No.: PCT/AT2008/000157

§ 371 (c)(1),
(2), (4) Date: May 20, 2010

(87) PCT Pub. No.: WO2008/154663

PCT Pub. Date: Dec. 24, 2008

(65) Prior Publication Data

US 2010/0251797 A1 Oct. 7, 2010

(30) Foreign Application Priority Data

Jun. 20, 2007 (AT) ..... A 956/2007

(51) Int. Cl.
*B21D 5/01* (2006.01)

(52) U.S. Cl. ..... 72/389.3; 72/389.4

(58) Field of Classification Search ..... 72/389.3, 72/389.4, 389.6, 390.4, 455, 456
See application file for complete search history.

(56) References Cited

U.S. PATENT DOCUMENTS

| | | | | |
|---|---|---|---|---|
| 1,569,461 | A | 1/1926 | Cronwall | |
| 2,461,034 | A | 2/1949 | Castle | |
| 4,123,929 | A | 11/1978 | Huydts | |
| 4,694,744 | A | 9/1987 | Hepburn et al. | |
| 5,531,087 | A * | 7/1996 | Kitabayashi et al. | 72/37 |
| 5,775,162 | A * | 7/1998 | Ward | 72/389.3 |
| 5,842,366 | A * | 12/1998 | Klingel et al. | 72/31.1 |
| 7,080,534 | B2 * | 7/2006 | Schneiderheinze | 72/21.3 |
| 7,325,428 | B2 * | 2/2008 | Bruggink | 72/15.1 |
| 7,513,135 | B2 * | 4/2009 | Denkmeier | 72/15.1 |
| 2009/0293576 | A1 * | 12/2009 | Shibata | 72/389.1 |

FOREIGN PATENT DOCUMENTS

| | | | |
|---|---|---|---|
| DE | 2625482 | A1 | 12/1977 |
| DE | 19809704 | A1 | 9/1999 |
| GB | 784981 | A | 10/1957 |
| GB | 2356592 | A | 5/2001 |
| JP | 04075798 | A | 3/1992 |
| JP | 04279217 | A | 10/1992 |
| JP | 05138253 | A | 6/1993 |
| JP | 2004066248 | A | 3/2004 |

OTHER PUBLICATIONS

International Search Report, PCT/AT2008/000157, dated Sep. 16, 2008.

* cited by examiner

*Primary Examiner* — Faye Francis
(74) *Attorney, Agent, or Firm* — Lerner, David, Littenberg, Krumholz & Mentlik, LLP

(57) ABSTRACT

Bending machine, in particular a folding press, including a machine frame, a press table supporting a lower die and connected to the machine frame, a press beam supporting an upper die and adjustable along a guide on the machine frame in the direction of the press table as well as at least one adjusting member for adjusting the press beam in the direction of the press table with two relatively adjustable adjusting elements, wherein a first adjusting element of the adjusting member is drive-connected by a first connecting element to the adjustable press beam. In this case a second adjusting element of the adjusting member is drive-connected by a second connecting element in or below a horizontal reference plane running through a press table bearing surface to the machine frame or the press table.

15 Claims, 3 Drawing Sheets

1
2
3
4
5
7
8
11
13
13'
15
15, 18
16, 17
17
19
24
25
26
27
28
29
30
31
31'
32
32'
33
34
37
39
40
43
44
45
46

BENDING MACHINE

CROSS REFERENCE TO RELATED APPLICATIONS

The present application is a national phase entry under 35 U.S.C. §371 of International Application No. PCT/AT2008/000157, filed May 7, 2008, published in German, which claims the benefit of Austrian Patent Application No. A956/2007, filed Jun. 20, 2007. The disclosures of said applications are incorporated by reference herein.

The invention relates to a bending machine, in particular a folding press, as described in the preamble of claim 1, as well as a method for driving a press beam of a bending machine, as described in the preamble of claim 19.

The bending of sheets on bending machines, in particular folding presses, is one of the most commonly used shaping methods, whereby in this case mainly free-bending or stamp-bending in a V-die is used. The bending machines used for this comprise in general a machine frame, a press table connected to the machine frame and supporting a lower die, a press beam supporting an upper die and adjustable along a guide on the machine frame in the direction of the press table, and at least one adjusting member adjusting the press beam in the direction of the press table. Mainly hydraulic cylinders are used as the adjusting members, which are arranged above the press beam and push the press beam downwards in the direction of the press table or a fixed lower press beam. A substantially straight bending edge is produced in this way on a sheet workpiece positioned between the upper die and the lower die.

With the arrangement of the adjusting members in the form of pressure cylinders above the press beam and the partly extremely high bending forces in the form of pressure forces required between the upper die and the lower die, said pressure forces have to be equalised in this arrangement by suitably high internal tensile forces in the machine frame. However, the tensile loads and bending loads acting on the machine frame during the pressing procedure cause slight deformations, even with a very stable construction of the machine frame, which can affect the precision of the bending result. Thus for example, in a machine frame which has a C-frame the high bending forces cause the C-stands to bend, which has to be compensated by expensive means to obtain the desired precision of the bending process.

The objective of the invention is to provide a bending machine, in which the forces required for the bending process progress advantageously and the machine frame is thus exposed to the lowest possible loading and deformation during the bending process or by means of a simpler structure of the machine frame the same bending precision can be achieved.

The objective of the invention is achieved in that a first adjusting element of the adjusting member, which adjusts the press beam in the direction of the press table is drive-connected by means of a first connecting element to the adjustable press beam, and a second adjusting element of the adjusting member is drive-connected to the machine frame or the press table by means of a second connecting element below a horizontal reference plane running through a press table bearing surface. During the pressing process the two connecting elements approach one another, thus shortening the adjusting member, whereby the press beam is pulled downwards against the press table or a fixed lower press beam, and is not, as known from the prior art, pressed downwards by the pressure forces of an adjusting member. The flow of force from the upper die to the lower die is not carried solely by the machine frame, but by the adjusting member in connection with the machine frame. If for example the machine frame is assembled with C-stands, the cross section of the stands, which mostly have their thinnest cross section at the height of the bending die, is not loaded by a tensile force corresponding substantially to the bending force, but only by a bending moment, which is created by the line of action of the resulting force of the adjusting member or members lying outside the bending plane. The line of action of the adjusting members runs approximately parallel to the direction of adjustment of the press beam along the guide on the machine frame.

The bending upwards or springing of a C-stand caused by the forces to be transmitted in the machine frame generally causes a slight displacement of the upper die in vertical direction and to a small degree also in horizontal direction, whereby the upper die can be made to tilt slightly with increasing bending force. Said tilting movement can, particularly in a bending process in which the bending of the upper die is compensated by a specific convexity of the lower die, affect the precision of the bending appreciably, as the beginning of the bending deformation of a wide workpiece takes place in the middle of the press beam even with relatively low bending forces, whereas the side areas of the workpiece are deformed only slightly later by the convexity with higher bending forces, however the described tilting effect can still occur and the precision of the bending can be affected appreciably. The relieving of the load on the machine frame according to the invention caused by the arrangement of the adjusting members can thus contribute to the prevention of this disadvantageous effect.

Although it is possible for the press beam to be driven by only one adjusting member, it is an advantage, if at least two adjusting members are drive-connected to the press beam. The bending machine is in this way much less sensitive to eccentric bending forces, for example several different bending die combinations are arranged for a bending sequence along the press table. Furthermore, in this way the tensile force to be applied by an adjusting member is lower than if said tensile force has to be produced by a single adjusting member.

In an advantageous design of the bending press, adjacent to both ends or face sides of the press table an adjusting member is arranged essentially in a bending plane running through the lower die and upper die. By means of this arrangement, in an extension of the press table or the upper press beam and in the bending plane, the bending moments acting on the machine frame are minimised, and with uniform rigidity of the machine frame smaller deformations are caused, for example by bending the C-stand, i.e. if the adjusting members are spaced apart from the bending plane and result of the tensile forces from the adjusting members lies outside the bending plane. Alternatively to this, with uniform deformations the machine frame can have smaller dimensions and thus can be produced more inexpensively.

The bending moments acting on the machine frame can also be minimised in that adjusting members are arranged on opposite sides of the bending plane. In particular, in an arrangement of the adjusting members that is symmetrical to the bending plane—provided that the adjusting members produce equal tensile forces—the bending moment produced by the bending force on the machine frame is negligible.

For many applications it is also an advantage if the adjusting members are arranged symmetrically to a vertical middle plane perpendicular to the bending plane, as the bending forces are introduced most frequently in the region of this middle plane into the press beam or the press table, and in this way oblique positions of the press beam are largely prevented during bending processes in the region of the middle plane. The symmetrical arrangement of the adjusting members relative to the middle plane is performed advantageously frequently on the end areas of the press beam, so that the area behind the press beam remains free with the greatest possible width for workpieces to be processed.

In a development of the bending machine according to the invention, on the machine frame or on the press beam a securing device is provided which fixes the press beam in position relative to the machine frame. Said securing device can have the function of a brake, by means of which movements of the press beam can be stopped in the shortest possible time or over a shortest possible distance, as can be necessary for example according to safety regulations.

Furthermore, said securing device can facilitate the assembly or refitting of the bending machine, for example in that an adjusting member can be exchanged with a raised press beam. The securing device can have an interlocking effect, for example a clamping effect in the region of the guide of the press beam or for example also an interlocking element blocking the displacement of the press beam, for example in the form of a safety bolt, which passes through the press beam and the machine frame. The securing device can however also be formed by a separate, additional adjusting member, which can develop corresponding pressure forces and in this way can transfer the weight of the press beam onto the machine frame.

In connection with a securing device it can be advantageous for the assembly and operation of such a bending machine, if by means of an uncoupling device the first connecting element of an adjusting member with the upper press beam or the second connecting element of an adjusting member is connected possibly detachably to the machine frame or press table. In this way the connection of the adjusting member to the press beam or the press table or machine frame can be released with little effort, for example if the adjusting member or one of its adjusting elements has to change position for working on the bending machine. The uncoupling device can comprise for example a movable bolt, which forms or releases an interlocking connection between the adjusting element and the press beam or machine frame or press table manually by the user or by an adjusting device controlled by a control and regulating device of the bending machine.

For working on the face sides of the press beam or the press table, for example for die replacement, it is an advantage if the first connecting element of the adjusting member is adjustable completely up to below the lower die or the second connecting element of the adjusting member is adjustable completely up to above the upper die. The adjusting member can thus be shorted until on the longitudinal face sides of the press beam and press table a free working space is created for the manipulation of bending dies.

The same advantage is achieved, if at least temporarily a free space is formed for the front side feeding of a lower die onto the press table and an upper die onto the press beam on at least one longitudinal face side of the press table. This can be achieved if necessary by an adjusting member that can be uncoupled from the first connecting element or the second connecting element and is adjustable in position. The uncoupling can be carried out as described above by a separate uncoupling device, whereby the position of the press beam can be fixed in relation to the machine frames by a previously described securing device. By means of this design also in an arrangement of the adjusting members in the bending plane if necessary the required free space can be created for changing bending dies on the face side. The adjusting member can be displaced for example by a pivot movement about the not uncoupled connecting element relative to the bending plane to the rear.

The adjusting member or members of the bending machine can be formed advantageously by a pressure-driven linear motor, whereby a first adjusting element comprises a cylinder and a cylindrical pipe and a second adjusting element comprises a piston guided in the cylinder and a piston rod leading out of the cylinder, whereby the linear motor is designed as a double-acting fluid cylinder, which can exert pressure for lifting the press beam as well as tensile force for puling the press beam against the press table during the bending process. The linear motor can in this case be arranged with a piston rod pointing upwards as well as downwards, as the function as a tensile member during the pressing procedure and the arrangement of the connecting elements on the press beam or in or below the press table bearing surface can be achieved on the press table or on the machine frame and the thereby achieved tension relief of the machine frame can be achieved with both arrangement variations. To achieve higher tensile forces, which are required for the bending process and the high rigidity of the adjusting member it is an advantage, if the latter is designed as a double-acting hydraulic cylinder, which has already been proved effective in the conventional arrangement above the upper press beam.

Alternatively or in addition to this, an adjusting member can also be formed by a spindle drive, whereby an adjusting element comprises a drive spindle and an adjusting element comprises a spindle nut cooperating therewith. Such an adjusting member in the form of a spindle drive is also characterised by high rigidity and can be operated without a complex hydraulic supply device, when the spindle is drive-connected to an electric motor. With the provision of a hydraulic supply device the spindle can also be driven by a hydraulically loaded rotation motor.

Although the connecting elements arranged on the adjusting elements of the control member can also be connected in a material-closed or force-closed manner to the press beam or the machine frame or press table, it is an advantage if the first connecting element or the second connecting element are connected by means of an interlocking element with the press beam or the machine frame or the press table. The interlocking element can be formed in one piece on the connecting element, for example in the form of extensions, which grip under a part of the press beam or machine frames. Alternatively to this, the interlocking element can be formed by a plug, bolt or pin, which can be removed if necessary, and allows a simple uncoupling of the connecting element of the adjusting member of the press beam or machine frame or press table, for example with a separate uncoupling device.

To achieve a high operating speed of the bending machine and an associated rational method of production it is an advantage if the press beam in both adjusting directions, i.e. both upwards and downwards has a possible adjustment speed of at least 155 mm/s, in particular at least 180 mm/s, preferably at least 220 mm/s. Such a rapid traverse function can be achieved in that a hydraulic cylinder with a high piston surface ratio is used, i.e. the piston crown surface is much greater than the piston rod side piston ring surface and the piston rod at constant flow of the hydraulic means enters much more quickly than it exits. In the arrangement of the adjusting members according to the invention in this way a rapid traversing movement of the press beam is performed downwards in order also to perform a rapid traversing movement upwards, additional adjusting members can be provided which can be smaller in size as they only have to overcome the weight forces and inertia forces of the press beam but do not have to impose the high bending force.

In order to perform the same operating processes as in folding press known from the prior art it is an advantage if the machine frame comprises two substantially vertical C-stands. In this way existing operating sequences can be taken over unchanged.

The objective of the invention is also achieved by means of a method for driving the press beam, in which during the pressing procedure to move the press beam closer to the press table a spacing between a first connecting element of a first adjusting element drive-connected to the press beam and a second connecting element drive-connected with the machine frame or the press table is shortened by a tensile force generated by the adjusting member, and in this way the second connecting element is drive-connected below a horizontal reference plane running through a press table bearing surface to the machine frame or the press table. By means of this use of an adjusting member which generates during the pressing process a tensile force instead of a compressive force the bending moment loading of the machine frames and thus also its deformation can also be reduced during the bending process.

In order to minimise the bending moments acting on the machine frame, it is advantageous, to execute the method such that adjusting members are arranged on both sides of the bending plane and the sum of products of the tensile force exerted by the adjusting members on the press beam with the distance of its respective line of action to the bending plane is almost the same on both sides of the bending plane. The resulting force of all adjusting members on one side of the bending plane thus has a precisely opposite acting bending moment about the bending line as the resulting force of all adjusting members on the other side of the bending plane.

The invention is explained in more detail in the following with reference to the exemplary embodiments shown in the drawings.

Figure 1:
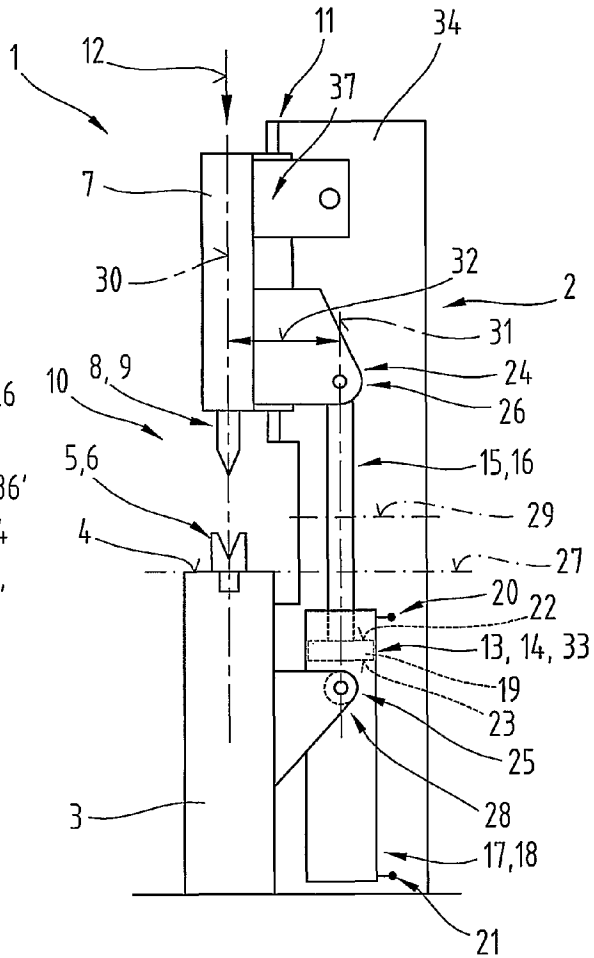
FIG. 1 shows a side view of a bending machine according to the invention in the form of a folding press.

First of all, it should be noted that in the variously described exemplary embodiments the same parts have been given the same reference numerals and the same component names, whereby the disclosures made throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

FIG. 1 shows a bending machine according to the invention in the form of a folding press 1. The latter comprises essentially a machine frame 2, which is connected in its lower section to a press table 3. The latter is designed as a solid, upright plate that is relatively thick, for example over 100 mm, but can also be designed as a press beam which does not extend to the ground. On the top side of the press table 3 a press table bearing surface 4 is formed, which supports a lower die 5 in the form of a female die, for example a V-die 6. Above the press table 3 a press beam 7 is arranged, which supports an upper die 8 in the form of a male die cooperating with the lower die 5, for example a bending stamp 9. The lower die 5 and upper die 8 together from a bending die 10, by means of which in a free bending process or a stamping bending process a bent edge can be produced in a not shown workpiece.

The press beam 7 in the exemplary embodiment shown is designed to be similar to the press table 3 as a solid vertically aligned plate and is mounted by means of a guide 11 in the direction 12 of the underlying press table 3 to be adjustable on the machine frame 2.

The adjustment of the press beam 7 in a direction 12 along the guide 11 is performed by an adjusting element 13, which is designed in the shown exemplary embodiment as a hydraulic cylinder 14. The adjusting element 13 comprises a first adjusting element 15 here in the form of a piston rod 16 of the hydraulic cylinder 14 and a second adjusting element 17 adjustable relative to the first adjusting element 15, here in the form of the cylindrical pipe 18 of the hydraulic cylinder 14. In the cylindrical pipe 18 a piston 19 connected to the piston rod 16 and acting on the latter is guided, which via pressure connections 20 and 21 on the cylindrical pipe either on the piston rod side piston ring face 22 or on the opposite piston crown face 23 can be pressurised by pressure means in the form of hydraulic oil. The pressure connections 20 and 21 are thus fed by a not shown hydraulic supply system.

In order to adjust the press beam 7, the adjusting member 13 is connected on the one hand to the press beam 7, and on the other hand to the machine frame 2 or as in the shown exemplary embodiment to the press table 3. In this case the first adjusting element 15 in the form of the piston rod 16 comprises a first connecting element 24, which is drive-connected to the press beam 7; similarly the second adjusting element 17 in the form of the cylindrical pipe 18 comprises a second connecting element 25, which is drive-connected to the press table 3. With this arrangement of the adjusting member 13 thus a first force action point 26 defined by the first connecting element 24 lies above a reference plane 27 defined by the press table bearing surface 4 and a second force action point 28 defined by the second connecting element 25 lies below the reference plane 27. This means that during a pressing process, as soon as the bending force to be applied is greater than the weight force of the press beam 7, by the adjusting member 13 a tensile force acting between the press beam 7 and press table 3 is applied and in this way the further increase of the bending force is achieved for shaping the workpiece. By means of this arrangement of the adjusting member 13 the tensile force acting between the press beam 7 and press table 3 corresponding to the bending force is transmitted not via stand cross sections 29 of the machine frame 2 from top to bottom, but by the adjusting member 13 itself. On the stand cross sections 29 of the machine frame 2 in this arrangement of the adjusting members 13 only one bending moment acts, which means that between a bending plane 30 running through the upper die 8 and lower die 5 and the middle lines of the adjusting members 13, the lines of action 31 of the tensile forces acting in the adjusting members 13 a distance 32 is defined, whereby through bending force and pulling force a torque is exerted onto the press beam 7, which has to be balanced by a diametrically opposite support moment in the guide 11 and the stand cross sections 29 are thus loaded by said support moment as the bending moment. Said bending moment is smaller, the shorter the distance 32 between the bending plane 30 and the resulting line of action 31 of the tensile forces exerted by the adjusting members 13, as the bending moment acting in the stand cross-section 29 is multiplied by the product from the bending force with the distance 32.

The hydraulic cylinder 14 can be referred to in general as a pressure-driven linear motor 33.

Figure 2:
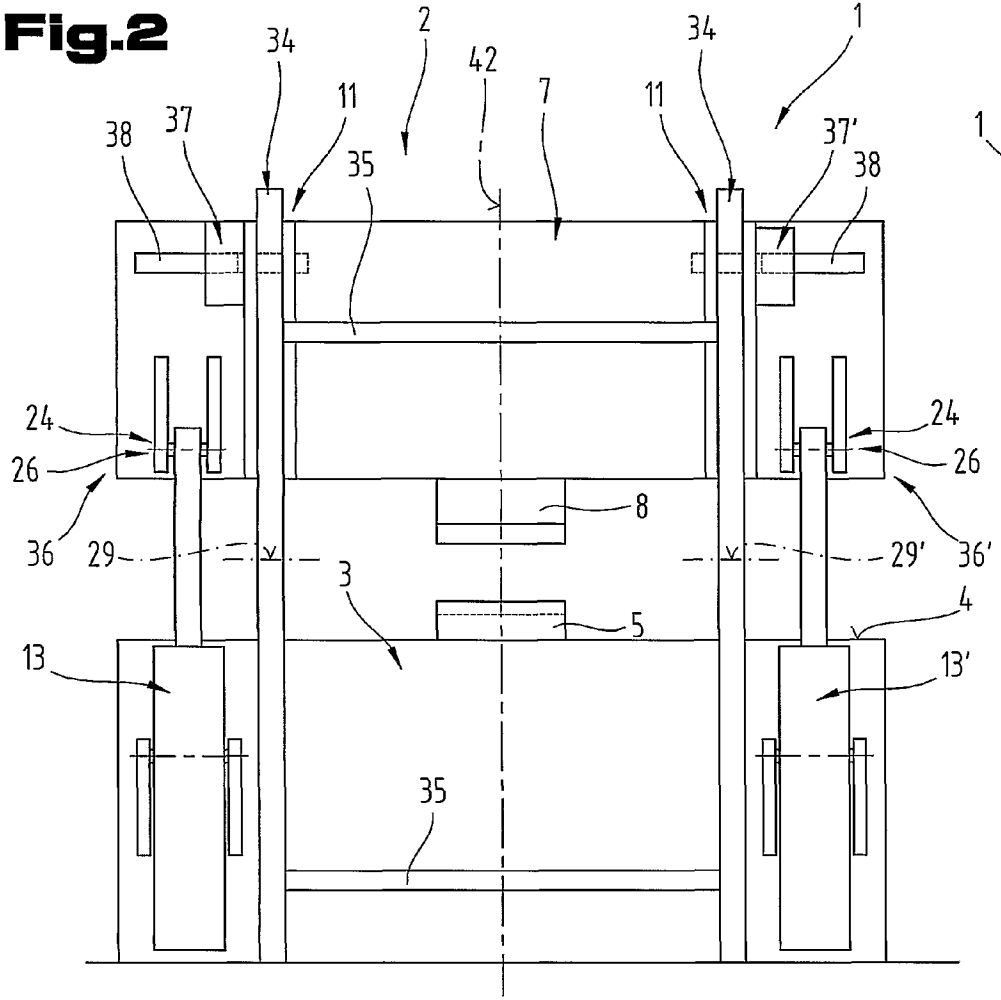
FIG. 2 shows a rear view of the folding press according to the design in FIG. 1.

FIG. 2 shows a rear view of a folding press 1 described with reference to FIG. 1, wherein the same components are provided with the same reference numbers and components, which have already been described with reference to FIG. 1, are therefore not explained in more detail. FIG. 2 shows that the machine frame 2 comprises substantially two board-like, vertical C-stands 34 as well as two horizontal cross members 35 connecting the latter. On the press beam 7 two adjusting members 13, 13' are arranged, which are drive-connected to the latter adjacent to end sections 36, 36' of the press beam 7.

The press beam 7 can be fixed in position relative to the machine frame 2 by means of two securing devices 37. Said securing device 37 comprises for example a safety bolt 38, which is inserted by the securing device 37 into a corresponding bore in the C-stand 34, and in this way can secure the position of the press beam 7 in an interlocking manner. Alternatively to this, the securing device 37 can also be in the form of a force-closed acting brake by means of which the press beam 7 can be secured in different positions on the machine frame 2.

Figure 3:
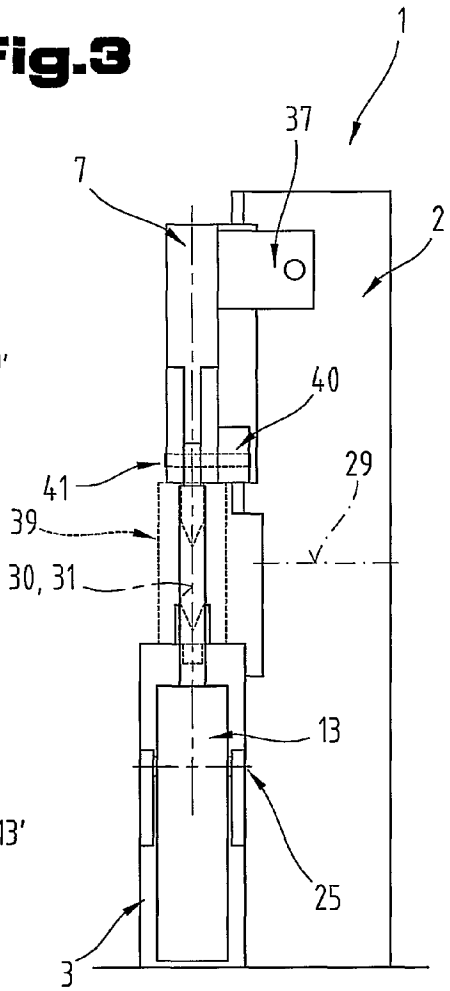
FIG. 3 shows a side view of a further embodiment of a bending machine according to the invention with the arrangement of the adjusting members in the bending plane.
Figure 4:
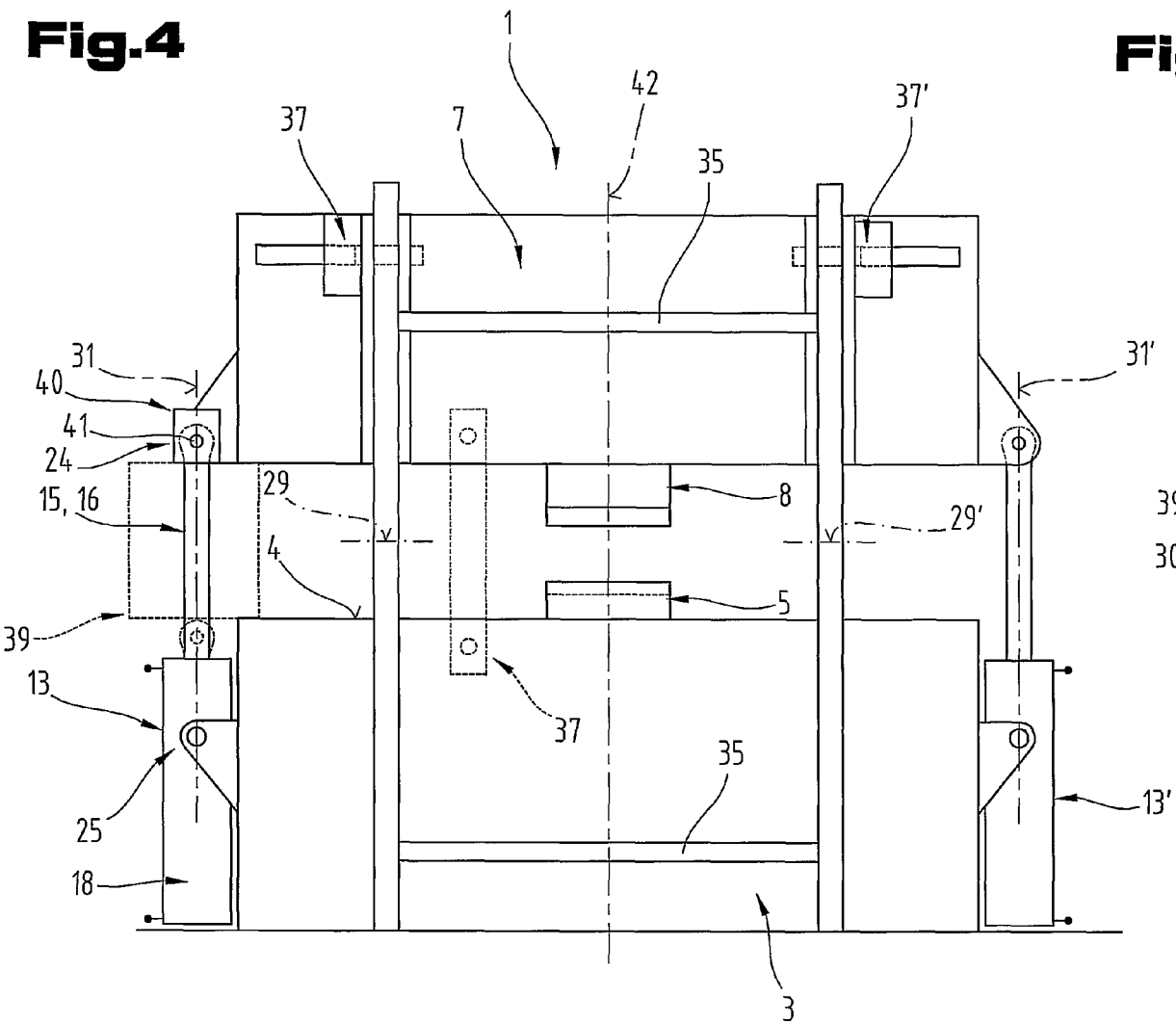
FIG. 4 shows a rear view of a bending machine according to the embodiment in FIG. 3.

A further embodiment of the bending machine according to the invention is shown in FIG. 3 as a side view and in FIG. 4 in a rear view.

In this embodiment the adjusting members 13, 13' are arranged such that their lines of action 31, 31' are in the bending plane 30, whereby the distance 32 between the lines of action 31, 31' and the bending plane 30 is inapplicable and by means of the bending force no bending moment is caused on the stand cross-sections 29, 29' of the machine frame 2, as the resulting force caused by the adjusting members 13, 13' lies in the bending plane 30 and on the press beam 7 no support moment caused by the bending force is required or effective. By means of the embodiment of the adjusting members 13, 13' as pulling members already described above the high bending force is not transmitted as a pulling force in the machine frame 2 and the loading of the stand cross sections 29, 29' is much lower than in the design of the adjusting members as pressing members, which press the press beam during the pressing process downwards against the press table 3 or a lower press beam.

FIG. 4 shows in dashed lines a free space 39, which allows a front-side feeding of a lower die 5 onto the press table 3 or an upper die 8 onto the press beam 7. As in this embodiment of the folding press 1 the adjusting member 13 is arranged precisely in extension of the bending plane 30, in this embodiment additional means are provided for creating this free space 39 if necessary. The adjusting member 13, which is drive-connected by its first connecting element 24 to the press beam 7, can be uncoupled by means of an uncoupling device 40 from the press beam 7, which is why the latter is fixed previously by means of the securing device 37 in its position on the machine frame 2. This uncoupling of the first connecting element 24 can, as indicated in FIGS. 3 and 4, be performed by pulling out a fastening bolt 41, whereby the first connecting element 24 on the first adjusting element 15 in the form of the piston rod 16 is uncoupled from the press beam 17, and the piston rod 16 then by driving completely into the cylindrical pipe 18 releases a free space 39 for the front side assembly or disassembly of bending dies.

As also shown in FIG. 4 by dashed lines, the securing device 37 can also be designed alternatively as a support element, which removes the weight force of the press beam with an uncoupled adjusting member 13 to the press table 3. The support element can thus have a fixed length, i.e. be designed in the form of strut, alternatively however it can be formed by a pressure-driven support cylinder.

By means of a not shown control and regulating device of the folding press 1 the uncoupling can be associated with the first connecting element 24 logically to the previous fixing of the press beam 7 by means of securing device 37.

As shown in both FIG. 4 and FIG. 2, it is advantageous, if the adjusting members 13, 13' are arranged symmetrically to a vertical middle plane 42 perpendicular to the press table bearing surface 4 or reference plane 27.

Figures 5, 6, 7:
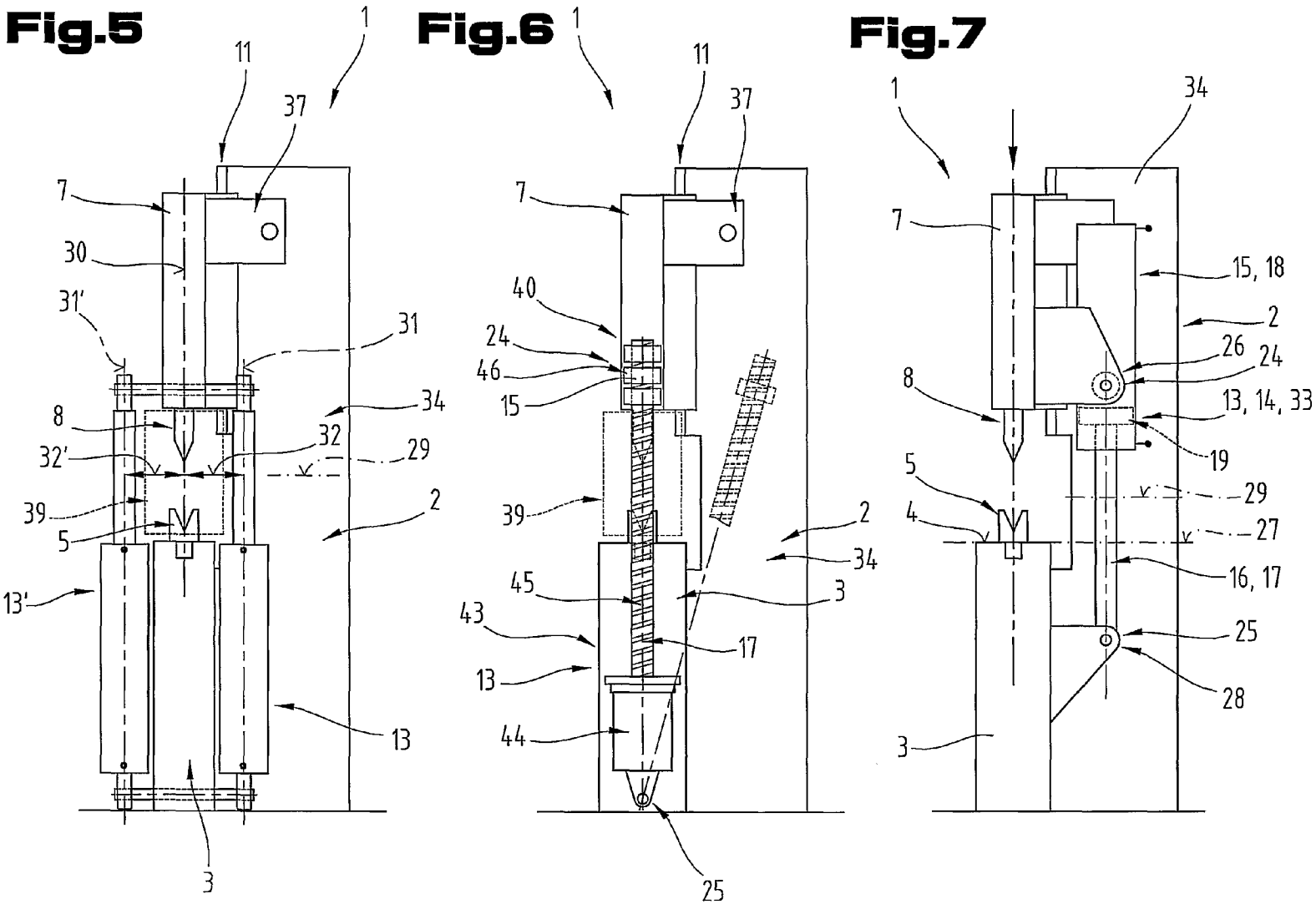
FIG. 5 shows a side view of a further embodiment of a bending machine according to the invention with an arrangement of the adjusting members on both sides of the bending plane.
FIG. 6 shows a side view of a bending machine according to the invention with a spindle drive as the drive for the press beam.
FIG. 7 shows a side view of a further embodiment of the bending machine according to the invention with a pressure-driven linear motor, in which the cylindrical pipe is arranged above the piston rod.

FIG. 5 shows a further embodiment of the bending machine according to the invention in the form of a folding press 1 in a simplified side view. In this embodiment of the folding press 1 adjusting members 13, 13' are arranged on opposite sides of the bending plane 30, whereby the distance 32 between the line of action 31 of the adjusting member 13 and the bending plane 30 is identical to the distance 32' of the line of action 31' to the bending plane 30 on the opposite side. The tensile forces produced by the adjusting members 13, 13' arranged symmetrically to the bending plane 30 together form a resultant force, which also lies in the bending plane 30 and in this way the stand cross-section 29 is free again from a bending moment loading caused by the bending force. Furthermore, by means of this arrangement of the adjusting members 13, 13' the free space 39 represented by dashed lines is available at any time for the assembly or disassembly of the upper die 8 and lower die 5.

Whereas in FIG. 5 the adjusting members 13, 13' are designed to be identical and also have identical distances 32, 32' between their lines of action 31 or 31' to the bending plane 30, it would also be possible for the adjusting members 13 and 13' to have different dimensions and thus also be able to produce different tensile forces, which can be balanced out in particular by different distances 32 or 32' of the respective lines of action 31 or 31' to the bending plane 30 and the press beam 17 by means of the bending force and the tensile forces does not introduce a bending moment into the machine frame 2.

FIG. 6 shows a side view of a further embodiment of a folding press 1 according to the invention, in which the adjusting member 13 is formed by a spindle drive 43, which comprises a spindle 45 driven by a motor 44, for example an electric motor or a hydraulic motor, and a spindle nut 46 cooperating therewith. The spindle nut 46 thus forms the first adjusting element 24 and the spindle 45 the second adjusting element 17. Furthermore, the spindle nut 46 forms at the same time the first connecting element 24, by means of which the adjusting member 13 is drive-connected to the press beam 7. The interlocking element 47 can also be formed, as shown in the other Figures, in particular by a bolt—such as a fastening bolt 41—, a pin or a plug.

To create the free space 39 for assembling or disassembling a bending die the adjusting member 13, in the form of the spindle drive 43 or also for example in the form of a hydraulic cylinder 14, as indicated by dashed lines, can be secured pivotably onto the machine table 3 or machine frame 2 or also to the press beam 7. In order to execute the pivot procedure, in turn a securing device 37 and an uncoupling device 40 is provided on the press beam 7, whereby the adjusting member 13 can be uncoupled from the fixed press beam 7.

FIG. 7 shows a modification of the folding press 1 according to FIG. 1, in which the adjusting member 13 in the form of a pressure-driven linear motor 33, in particular in the form of a hydraulic cylinder 14, is installed in reverse orientation to the design in FIG. 1. In this embodiment the cylindrical pipe 18 as the first adjusting element 15 is drive-connected by the first connecting element 24 to the press beam 7, whereas the piston rod 16 connected to the piston 19 as the second adjusting element 17 is drive-connected by the second connecting element 25 to the press table 3. The first force action point 26 on the press beam again lies above the upper die 8 and the second force action point 28 lies below the reference plane 27 defined by the press table bearing surface 4. In particular, the two force action points 26, 28 lie above or below the stand cross section 29 to be relieved of load by the tensile force or a section of the machine frame 2 to be relieved of load.

The action of the hydraulic cylinders 14 is as described as for the design referring to FIG. 1, in particular the tension relief of the machine frame 2 in its stand cross sections 29, which tension relief is achieved by the function of the adjusting member 13 as a tension member 9.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

The exemplary embodiments show possible embodiment variants of the bending machine, wherein it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field. Thus all conceivable embodiment variants, which are made possible by combining individual details of the embodiment variants shown and described, are also covered by the scope of protection.

Finally, as a point of formality, it should be noted that for a better understanding of the structure of the bending machine, the latter and its components have not been represented true to scale in part and/or have been enlarged and/or reduced in size.

The problem forming the basis of the independent solutions according to the invention can be taken from the description.

Mainly the individual embodiments of the bending machine shown in FIGS. 1, 2; 3, 4; 5; 6; 7 can form the subject matter of independent solutions according to the invention. The objectives and solutions according to the invention relating thereto can be taken from the detailed descriptions of these figures.

List of Reference Numerals

1 Folding press
2 Machine frame
3 Press Table
4 Press table bearing surface
5 Lower die
6 V-die
7 Press beam
8 Upper die
9 Bending Stamp
10 Bending die
11 Guide
12 Direction
13 Adjusting member
14 Hydraulic cylinder
15 Adjusting element
16 Piston rod
17 Adjusting element
18 Cylinder pipe
19 Piston
20 Pressure connection
21 Pressure connection
22 Piston ring surface
23 Piston crown surface
24 Connecting element
25 Connecting element
26 Force action point
27 Reference plane
28 Force action point
29 Stand cross section
30 Bending plane
31 Line of action
32 Distance
33 Linear motor
34 C-stands
35 Cross member
36 End section
37 Securing device
38 Safety bolt
39 Free space
40 End coupling device
41 Fastening bolt
42 Middle plane
43 Spindle drive
44 Motor
45 Spindle
46 Spindle nut
47 Interlocking element

The invention claimed is:

1. A bending machine, in the form of a folding press, comprising:

a machine frame having a guide, a press table connected to the machine frame, a lower die supported by the press table, a press beam adjustable along the guide on the machine frame in the direction of the press table, an upper die supported by the press beam and at least one adjusting member adjusting the press beam in the direction of the press table with first and second adjusting elements which are adjustable relative to one another, wherein the first adjusting element is drive-connected by means of a first connecting element to the adjustable press beam, wherein the second adjusting element is drive-connected by means of a second connecting element to the machine frame or the press table in or below a horizontal reference plane running through a press table bearing surface, wherein a securing device is arranged on the machine frame or on the press beam to fix the press beam in position relative to the machine frame, the first connecting element detachably connected to the upper press beam, or the second connecting element is detachably connected to the machine frame or the press table, whereby on at least one lateral surface of the press table at least temporarily a free space is formed for the front feeding of a lower die onto the press table and an upper die onto the press beam.

2. The bending machine according to claim 1, wherein at least two adjusting members are drive-connected to the press beam.

3. The bending press according to claim 2, wherein the adjusting members adjacent to both face sides of the press table are arranged substantially in a bending plane running through the lower die and upper die.

4. The bending machine according to claim 2, wherein the adjusting members are arranged on opposite sides of the bending plane.

5. The bending machine according to claim 4, wherein the adjusting members are arranged symmetrically to the bending plane.

6. The bending machine according to claim 2, wherein the adjusting members are arranged symmetrically to a vertical middle plane at right angles to the bending plane.

7. The bending machine according to claim 6, wherein the first connecting element of the adjusting member can be adjusted to be completely underneath the lower die or the second connecting element of the adjusting member can be to be adjusted completely above the upper die.

8. The bending machine according to claim 1, wherein the adjusting member is formed by a pressure-driven linear motor, whereby one of the first or second adjusting elements comprises a cylindrical pipe, and the other one of the first or second adjusting elements comprises a piston guided in the cylindrical pipe and a piston rod leading out of the cylindrical pipe.

9. The bending machine according to claim 1, wherein the adjusting member comprises a double-acting hydraulic cylinder.

10. The bending machine according to claim 1, wherein the adjusting member comprises a spindle drive, whereby one of the first or second adjusting elements comprises a drive spindle and the other one of the first or second adjusting elements comprises a spindle nut cooperating therewith.

11. The bending machine according to claim 10, wherein the drive spindle is drive-connected to an electric motor.

12. The bending machine according to claim 1, wherein the first connecting element or the second connecting element are connected by an interlocking element to the press beam or the machine frame or the press table.

13. The bending machine according to claim 12, wherein the interlocking element is formed by one of a plug, bolt or pin.

14. The bending machine according to claim 1, wherein the press beam can be both adjusted in two directions and has a potential adjustment speed of at at least 220 mm/s.

15. The bending machine according to claim 1, wherein the machine frame comprises two substantially vertical C-stands.

* * * * *